United States Patent [19]

Kartheus et al.

[11] Patent Number: 4,947,834

[45] Date of Patent: Aug. 14, 1990

[54] DEVICE FOR TREATING HUMAN EXTREMITIES

[75] Inventors: Holger Kartheus; Hanns Pietsch; Andreas Hogrefe, all of Hamburg; Harald Bargsten, Ahlerstedt; Berndt Voss, Norderstedt; Vignir Arnason, Ahrensburg, all of Fed. Rep. of Germany

[73] Assignee: Beiersdorf AG, Hamburg, Fed. Rep. of Germany

[21] Appl. No.: 305,432

[22] Filed: Feb. 1, 1989

[30] Foreign Application Priority Data

Feb. 10, 1988 [DE] Fed. Rep. of Germany ..... 3804016

[51] Int. Cl.[5] ..... A61H 9/00

[52] U.S. Cl. ..... 128/64; 128/DIG. 20

[58] Field of Search ..... 128/64, 24 R, DIG. 20, 128/44

[56] References Cited

U.S. PATENT DOCUMENTS

| | | | |
|---|---|---|---|
| 1,608,239 | 11/1926 | Rosett | 128/44 |
| 2,345,073 | 3/1944 | Rosett | 128/44 |
| 2,361,242 | 10/1944 | Rosett | 128/44 |
| 2,528,843 | 11/1950 | Poor | 128/DIG. 20 |
| 2,533,504 | 12/1950 | Poor | 128/60 |
| 3,824,992 | 7/1974 | Nicholson et al. | 128/64 |
| 3,862,629 | 1/1975 | Rotta | 128/64 |
| 3,866,604 | 2/1975 | Curless et al. | 128/64 |
| 4,066,084 | 1/1978 | Tillander | 128/24 R |
| 4,311,135 | 1/1982 | Brueckner et al. | 128/64 |
| 4,538,604 | 9/1985 | Usry et al. | 128/911 |
| 4,577,626 | 3/1986 | Marukawa et al. | 128/64 |
| 4,595,005 | 6/1986 | Jinotti | 128/205.24 |
| 4,667,672 | 5/1987 | Romanowski | 128/DIG. 20 |
| 4,762,121 | 9/1988 | Shienfeld | 128/64 |
| 4,805,601 | 2/1989 | Eischen, Sr. | 128/64 |
| 4,840,173 | 6/1989 | Porter III | 128/911 |

FOREIGN PATENT DOCUMENTS

| | | | |
|---|---|---|---|
| 663981 | 5/1965 | Belgium | 128/DIG. 20 |
| 0848028 | 7/1981 | U.S.S.R. | 128/64 |

*Primary Examiner*—Edgar S. Burr
*Assistant Examiner*—Tonya Lamb
*Attorney, Agent, or Firm*—Balogh, Osann, Kramer, Dvorak, Genova & Traub

[57] ABSTRACT

A device is disclosed which comprises at least one sleeve having a number of chambers. The sleeve may be placed around the patient's extremity which is to be treated, and the chambers can be inflated and deflated by means of valves. To accomplish an optimum treatment of the patient and an uncomplicated construction of the device, all the valves are connected in series and arranged to be operated successively in cascade-fashion via common feed and control pipes which are connected only to the first valve, whilst downstream each pair of mutually adjacent valves are interconnected via sections of feed and control pipes. In each valve a valve member such as a diaphragm separates a supply volume of the valve, which is in constant communication with an infeeding feed pipe section and with the assoicated chamber, from a valve control volume which is in constant communication with the control pipe. After the corresponding chamber is filled, the valve member of the valve uncovers a valve opening, thereby allowing supply air to reach the next valve downstream of it to inflate the next chamber.

11 Claims, 6 Drawing Sheets

DEVICE FOR TREATING HUMAN EXTREMITIES

BACKGROUND OF THE INVENTION

1. Field of the Invention

The invention relates to a device for treating human extremities by means of intermittent compression of the type comprising at least one sleeve for application on the bodily parts in question, having flexible chambers arranged one after another in series which may be successively inflated and then deflated under automatic control, having a number of valves corresponding to the number of chambers, each of which one is associated with chamber and by means of which the inflation and deflation of the chambers is controllable, as well as a feed pipe supplied from a compressed air source via a control system, whereby the chambers may be supplied with compressed air via the valves.

2. Description of the Prior Art

A device of this type has been described in the German published Patent specification No. 25 01 876. In this device, the separate inflatable chambers are directly interconnected by means of valves, the valves furthermore each being connected to short branch pipes which are in turn supplied by a common feed pipe supplied from a compressor. The individual valves which are thus connected in parallel, and are all supplied with compressed air at the same time for inflation of the chambers, operate one after another however, so that at first only the distal chamber is inflated. After its maximum pressure is reached, the valve of the distal chamber is switched over which couples it to the next chamber in the proximal direction, so that the next proximally following chamber is then inflated through the branch pipe just referred to, whilst the distal chamber is vented to the open air or into a return pipe. These operations are repeated from one chamber to another. Whilst the chamber which is next in each case is thus being filled, the chamber preceding it is vented at the same time, so that a peristaltic or undulant pressure is applied to the patient's limb by means of the inflating and deflating chambers.

A disadvantage of this device consists in that the period during which each chamber becomes and stays inflated is substantially uncontrollable. A rapid inflation of the chambers on the one hand and a comparatively protracted persistence of the inflated state of the chambers on the other hand, are thus impossible. Even the venting stages are no longer variable once a valve has been assembled and installed except by a change of the volumetric flow of the inflating compressed air, so that it is impossible to undertake a treatment best suited to the current state of the patient's complaint. Furthermore, the valves are of very complex structure and therefore difficult to manufacture, so that the valves can be produced only at a very high investment cost.

SUMMARY OF THE INVENTION

Accordingly it is an object of the invention to improve a device of the aforementioned type so that the device is considerably simplified in structure and the simplified structure allows all the data of significance to a patient's therapy to be set up individually.

This object is achieved in accordance with the invention in that all the vlaves are connected in series and controllable via a common control pipe supplied from the pressure source, the feed pipe and the control pipe being connected only to the first valve present at the distal end of the sleeve, whereas two valves adjacent one another are in each case interconnected via sections of feed pipe and of control pipe, each valve having a valve element separating a supply volume of the valve, which is in constant communication with an incoming feed pipe section on the one hand and with the associated chamber, from a control volume of the valve in constant communication with the control pipe, the said element of each valve uncovering a valve opening after the filling of the corresponding chamber, to connect it via its own flow path to the supply volume of the next valve.

The device is simplified considerably thanks to this solution, that is to say by virtue of the very uncomplicated form of the valves associated with the chambers as well as of their pattern in series connection and their by-pass position with respect to the chambers in question. To inflate the chambers, the valves are kept closed initially by means of the common compressed air control pipe, after which they are supplied with inflating air via the common feed pipe, which can initially penetrate into the first chamber only. Once the latter is filled, the force of the chamber compression of the filled chamber opens the valve passage of the valve associated with this chamber against the appropriately adjusted control pipe compressive force representing the valve closing force, so that it is only then that the next proximally following valve, and thereby is associated chamber, are supplied with inflating air, and so on in sequence.

Once the inflation has been completed in this cascade-fashion, all the chambers are in the inflated state. Furthermore, a sleeve constructed in this manner may be so operated that all the operating parameters of importance to a successful treatment of the patient may be set up. It is thus possible to establish in an uncomplicated way not only the pressure but also the duration of the inflated condition of the chambers as well as the duration of the intervening intervals, by means of a control system preconnected to the sleeve, just as it is possible to determine the duration of the inflating operation. The chronological sequences in question may consequently be set up in accordance with the pattern of the patient's complaint.

In a preferred embodiment of the invention the valves are of a pneumatically operated structure and are structurally identical, each with a valve element in the form of a diaphragm clamped in the valve casing. Preferably a hollow central connector stub is provided in the supply volume of each valve, the free end of which forms the aforesaid valve opening. The stub is connected via a passage extending in the supply volume to an inflation air valve outlet leading to the next valve, and the supply volume of each valve is in communication with the corresponsing chamber via a short connecting pipe.

BRIEF DESCRIPTION OF THE DRAWINGS

Further objects and advantages of the invention will become apparent from the following detailed description when read in conjunction with the accompanying drawings which illustrate a preferred embodiment thereof.

In the drawings.

DETAILED DESCRIPTION OF THE PREFERRED EMBODIMENT

Figure 1:
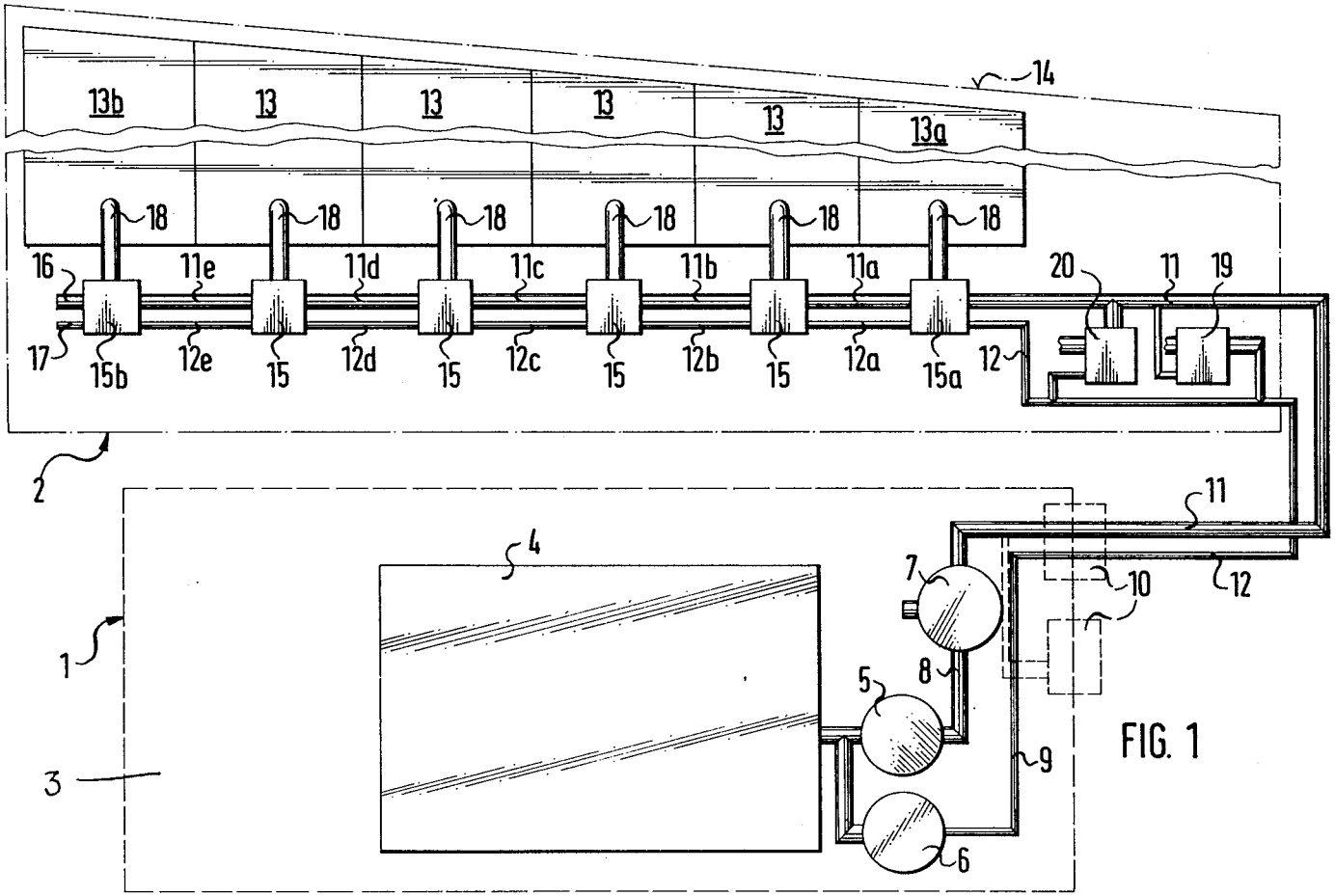
FIG. 1 is a schematic illustration in plan view of a device for treating human extremities in accordance with a preferred embodiment of the invention.

Referring to FIG. 1, a device according to the invention comprises a control system 1 and at least one sleeve 2 which is placed in a known manner around the leg or arm of a patient and the general structure of which is described in the following.

The control system 1 incorporates a compressor 4 stowed in a housing 3 for the purpose of generating compressed air for a sleeve 2, the compressed air flow from the compressor being split into a main flow for inflating air, a series of chambers provided in the sleeve and a control flow for controlling valves associated with the chambers. The two flows are adjustable by means of regulators 5 and 6 in respect of their pressure level as well as of their flow volumes, the regualtor 5 for the main flow being followed downstream thereof by an electrically controlled main venting valve 7 which discharges to the open air. The pipe sections 8 and 9 extending within the housing 3 for the two compressed air flows lead to a coded plug-type connector 10 from which emerge a feed pipe 11 carrying the main air flow and a control pipe 12 carrying the control air flow. As illustrated, the two pipes 11 and 12 are constructed as separate pipes. They may however also be joined together along a line on their outer sides. A dual pipe of this nature may be produced for example by co-extrusion.

Other connectors 10 of the plug type are provided in cases where several sleeves 2 are to be connected to the control system 1, one such additional plug-type connector being shown in broken lines in FIG. 1.

The sleeve 2 comprises a sleeve envelope 14 the material of which comprises a fabric permeable to air and water vapour and resistant to disinfectants, acids and alkalis, and a number of inflatable chambers 13 which as seen in the longitudinal direction of the envelope 14, extend transversely to the envelope and partially overlap one another. This arrangement is more clearly apparent from FIG. 5. The length of the individual chambers 13 is such that the chambers extend around the whole circumference of the extremity which is to be treated. Furthermore, the chambers are produced from precut plastics material sections and are thermoplastically interwelded along their marginal portions, so that they are airtight.

The sleeve 2 also contains valves 15 corresponding in number to the chambers 13 and each associated with one of these, which exercise direct control over the inflation and venting of the chambers, the first chamber 13*a* being the distal chamber and the last chamber 13*b* being the proximal chamber. The pipes 11,12 already referred to for the supply of compressed air to the valves 15 and to the chambers 13 terminate at the distal valve 15*a*. Beyond this valve, intermediate sections 11*a*–11*e* of the feed pipe 11 and intermediate sections 12*a*–12*e* of the control pipe 12 interconnect the valves 15, as is clearly apparent from FIG. 1. Since all the valves 15*a*,15,15*b* are of structurally identical form, of the proximal valve 15*b* has onward-leading connectors 16 and 17 which are closed. Finally, all the valves are joined via respective short connecting pipes 18 to the corresponding chambers 13. Moreover, a pressure limiter valve 19 and a venting valve 20 which can discharge to the open air are connected in parallel between the feed pipes 11 and 12 upstream of the distal valve 15*a*. It will be undersatood that the valves and their connectors as well as other connectors and materials and parts of the sleeve 2 will be designed to withstand disinfectants, acids and bases.

Figure 2:
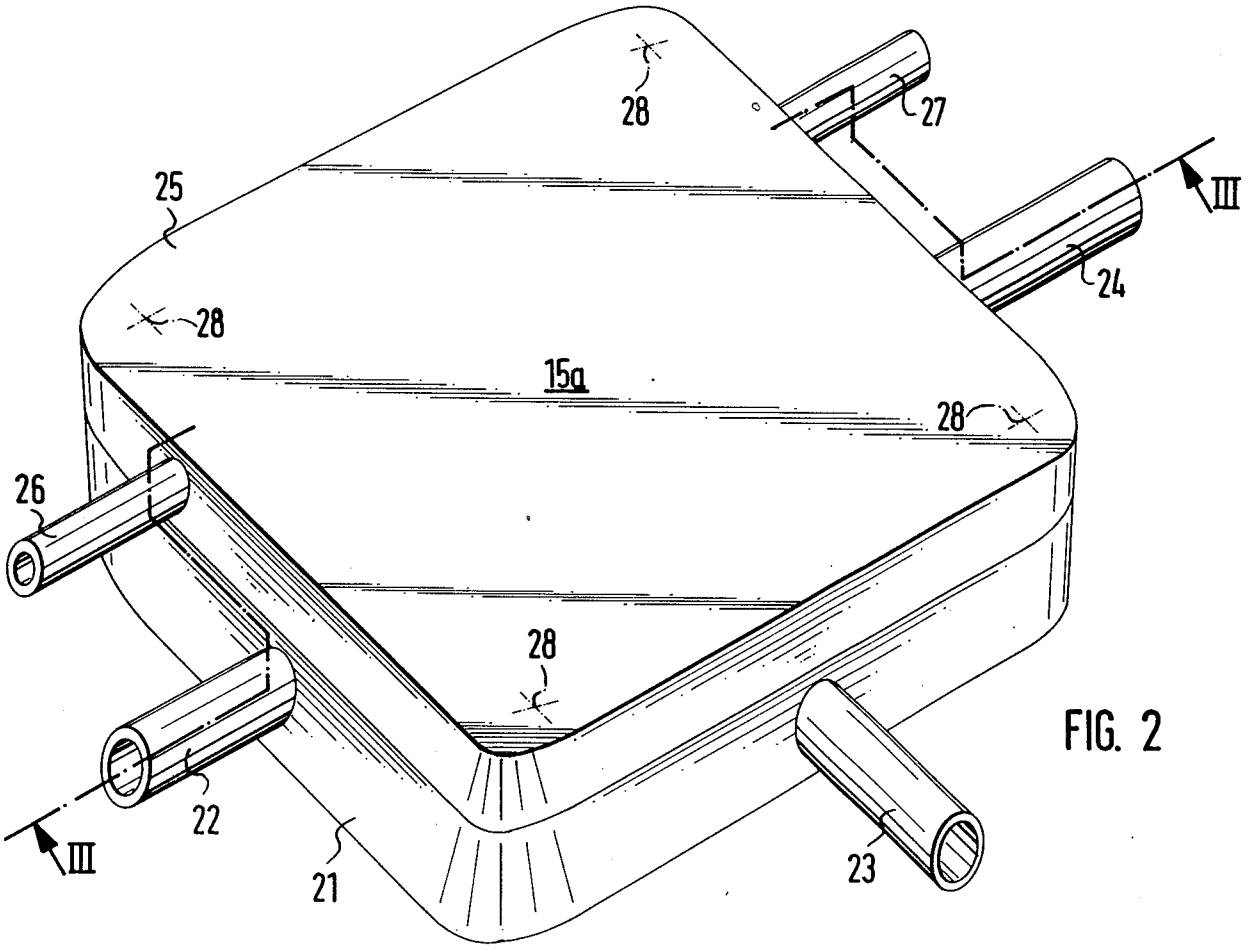
FIG. 2 is a perspective view of a chamber valve used in the embodiment of FIG. 1.
Figure 3:
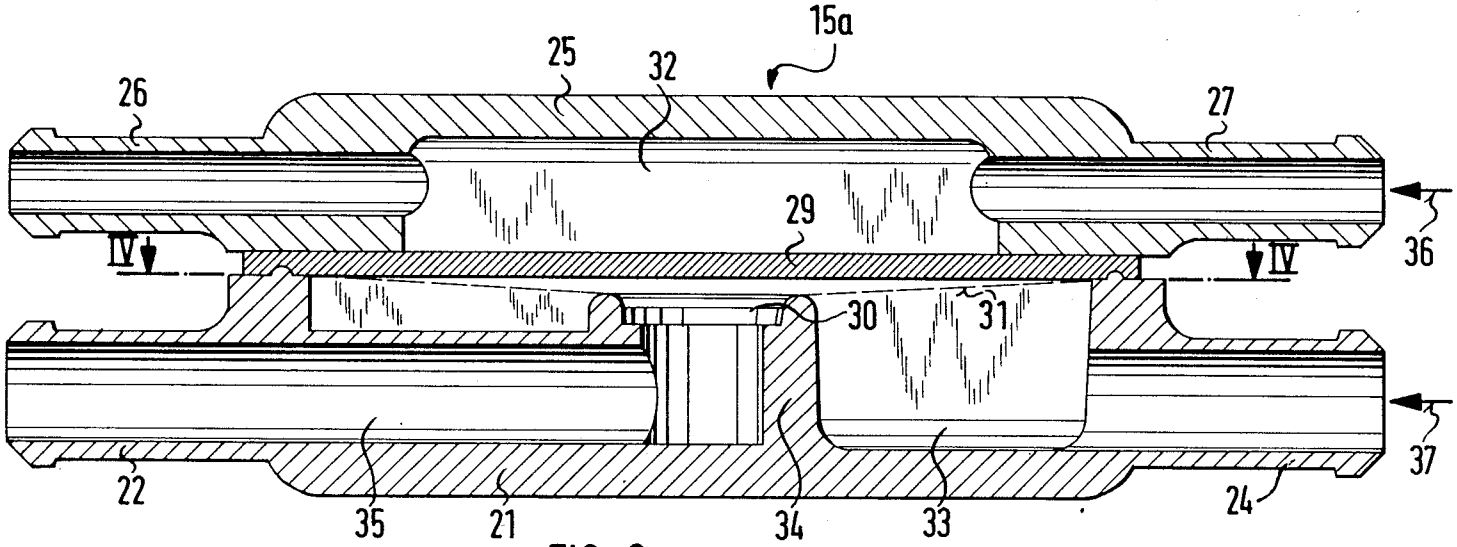
FIG. 3 is a cross-section along the line III—III in FIG. 2.
Figure 4:
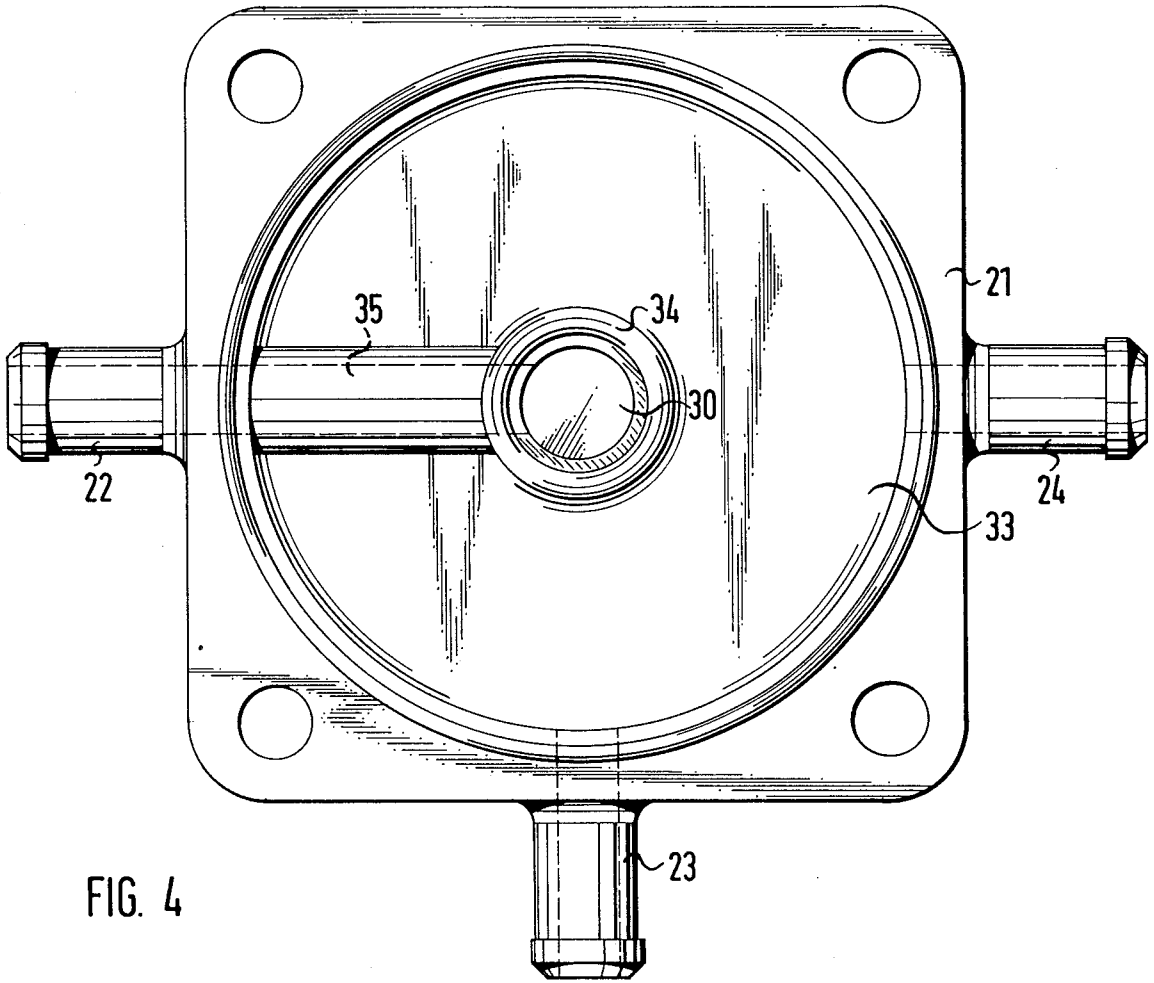
FIG. 4 is a plan view in the direction IV—IV of a lower portion of the chamber valve in FIG. 3.

Since all the valves 15,15*a*,15*b* are identical, only the distal valve 15*a* will be described in detail. As shown in FIGS. 2,3 and 4, each valve comprises a lower housing element 21 with the air supply connectors 22,23 and 24, and an upper housing element 25 with the two air control cnnectors 26 and 27. The two housing elements 21,25 are rivetted together at 28 in their corner areas. As is apparent from FIG. 3, a flexible diaphragm 29, which shuts off a valve opening 30 when it is acted upon by controlling air pressure, is clamped as a valve member between the two housing elements. The closed position of the diaphragm is denoted by a broken line 31. It is also apparent from FIG. 3 that the diaphragm forms an upper control volume 32 and a lower supply volume 33 in the valve, the diaghragm 29 forming an airtight seal between them. A hollow central stub 34 is positioned in the supply volume 33, the free upper end of which forms the said valve opening 30 and which is in communication, via a channel 35 extending in the supply volume, with the connector 22 acting as a valve outlet.

Each valve operates in the following manner. The control volume 32 is initially acted upon by means of compressed air indicated by the arrow 36, so that the diaphragm 29 closes the valve opening 30. When inflating air then flows into the supply volume 33 via the pipe 11 according to the arrow 37, the said air may initially merely flow through the connector 23 (FIG. 4) into the chamber 13 connected to this valve to fill it. Once this chamber is filled, the pressure of the air in the chamber, which is higher than the pressure of the air used for control in the control volume 32, causes the diaphragm to lift and uncover the valve opening 30 of the stub 34, so that feed air may then flow via the passage 35 and the connector 22 to the inlet connector 24 of the next valve 15. The corresponding chamber of this next valve is again filled initially, since the diaphragm in question prevents any outflow from the valve.

Figure 5:
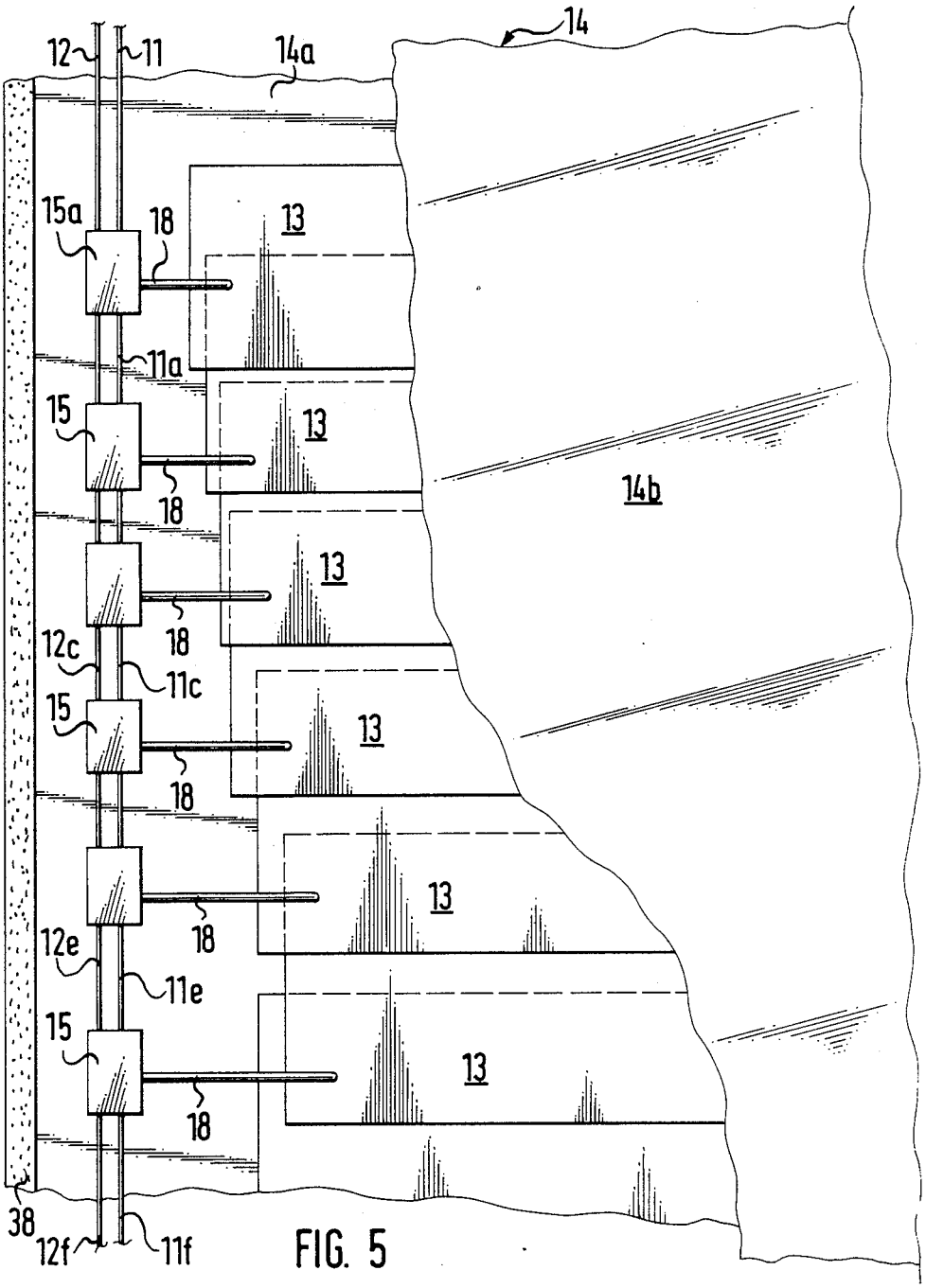
FIG. 5 is a partial plan view of a sleeve.

The overlapped positioning of the chambers 13 is clearly apparent from FIG. 5. It is apparent furthermore that the valves 15 and their pipes 11,12,11*a*–11*f* as well as 18 are also covered by the material of the sleeve. The sleeve envelope 14 advantageously comprises two layers, with an inner layer 14*a* screening the individual chambers 13, the valves 15 and the different hose pipes 11,12 etc. from the patient, and an outer layer 14*b* screening the said elements from the environment. The two layers 14*a* and 14*b* which may be formed by single folding-over of a larger single layer, may for example be held together by means of a so-called VELCRO, or hook and loop type, closure 38, in a manner known per se. The double-layer sleeve envelope 14 itself is similarly held together by means of a VELCRO closure (not shown) after it has been laid around the patient's extremity which is to be treated.

Figure 6:
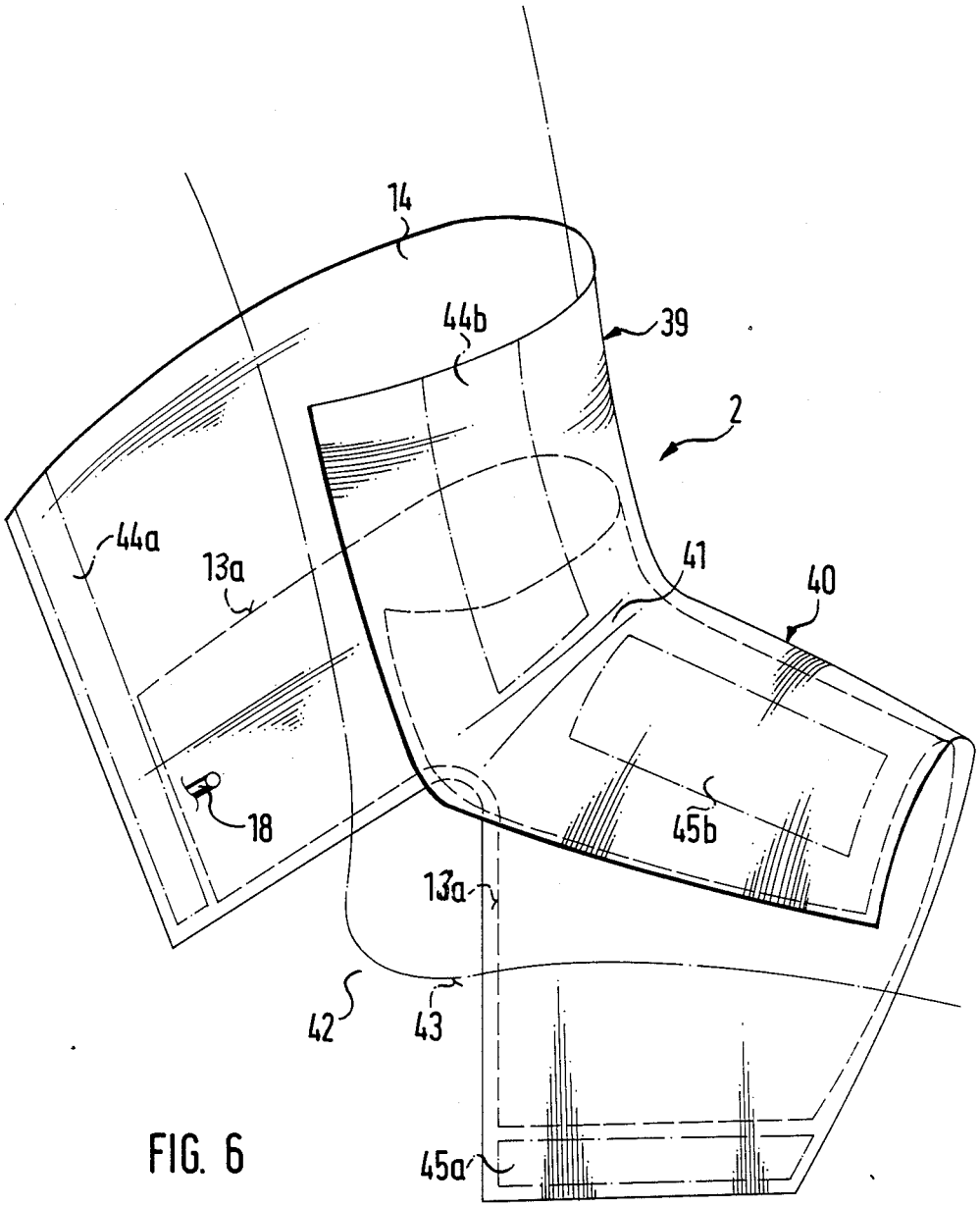
FIG. 6 is a partial plan view of a lower portion of the sleeve.

For the purpose of treating legs, FIG. 6 shows an enlarged sleeve 2 the thin portion 39 of which is shown only partially and in very simplified manner, to provide a clearer grasp of the following description. To prevent bodily fluids form being cut off, as is the case with known sleeves, during application of the sleeve in the area of transition between the instep of the foot and the lower leg of the patient, the double-layer envelope 14 of the sleeve is provided with a foot portion 40, in such a way that the envelope extends without interruption in the said area of transition 41 from the lower leg section to the instep section, preferably in one piece in this area. Furthermore, the envelope 14 is so constructed that an approximately triangular excision 42 is present in the open state in the heel section between the lower extremity of the lower leg portion 39 and the foot portion 40 of the envelope, which leaves the patient's heel 43 uncovered during use of the sleeve, as can be seen from FIG. 6. The risk of obstruction is improbable in this area.

In a preferred embodiment, the chamber 13*a* present at the distal end of the sleeve is so enlarged that it forms a common one-piece chamber together with the chamber for the foot portion 40 which substantially encompasses the whole foot portion, as depicted by the broken-line illustration in FIG. 6. This ensures an optimum return flow of bodily fluids out of the patient's foot whilst preventing an obstruction in the area of transition 41 between the instep of the foot and the lower end of the patient's lower leg, when the chamber 13*a* of the sleeve applied is inflated via the connecting pipe 18. The sleeve 2 is closed and secured to the patient's limb by means of the VELCRO closures 44*a*,44*b* and 45*a*, 45*b*.

The device described in the foregoing operates as follows. The inflation of the sleeve is begun when the sleeve 2 has been applied to the appropriate extremity of the patient and the corresponding therapeutic data have been set up on the control system 1. All the valves 15 are closed at the same time by the controlling air pressure in the control pipe 12, since each diaphragm 29 in question bears on the corresponding stub connector 34 and thereby keeps its valve opening 30 closed. Supply air or inflation air then flows via the pipe 11 to the first distal valve 15*a*, that is to say into its supply volume 33 and from there into the first chamber 13 via the connector 23 and the connecting pipe 18, thereby filling the said chamber. Once this chamber has been filled, the pressure of the supply air which is higher than the pressure of the control air in the control pipe 12, causes the diaphragm 29 of the valve 15*a* to be lifted off the stub connector 34 so that its valve opening 30 is uncovered, feed air then being enabled to flow onwards through the inner passage 35, the connector 22 and the intermediate section 11*a*, to the next valve 15 of the series, so that the chamber connected to this valve is then filled in turn.

These operations are repeated until the proximal chamber 13*a* has been filled via the proximal valve 15*b*. Since the valve 15*b* is the final valve, all the chambers 13 are then filled, and this condition is maintained for as long as necessary. The control system thereupon implements a simultaneous deflation of all the chambers, the control pipe 12 being depressurised via the regulator 6 and the air in the chambers escaping to the atmosphere by means of the venting valve 20, all the valves 15,15*a*,15*b* being opened by placing the diaphragm 29 in the open position. An interval then follows, during which the chambers remain vented. This intervel may also be set up on the control system 1, in accordance with specific requirements. Another inflating operation then follows in the manner described.

We claim:

1. A device for treating human extremities by intermittent compression, comprising: at least one sleeve adapted to fit around a patient's limb; a plurality of flexible inflatable chambers attached to said sleeve and arranged in series thereon to be successively inflated; a valve associated with each said inflatable chamber, each said valve having a supply volume communicating with its associated chamber and an inlet for inflating air to said supply volume, and each of said valves other than that associated with the last chamber of said series having an outlet from its supply volume connected to the inlet to the supply volume of the valve of the next chamber in said series, a control volume separate from said supply volume and a pneumatically operated valve member arranged to close off said supply volume outlet when a predetermined pressure differential prevails between said supply volume and said control volume and means for supplying a control pressure to each of said control volumes, whereby when inflating air is supplied to the first chamber of the series through its respective valve inlet with all said valve outlets closed by said control pressure, said first chamber inflates until the pressure therein, and in its associated valve supply volume, rises to overcome said pressure differential and cause said valve member to open said outlet to enable the next chamber in the series to be inflated through its respective valve supply volume while keeping said first chamber inflated, and so on until all said chambers are inflated, wherein the sleeve compprises a foot portion including an instep portion and a shin portion, a transition area joining the foot portion without interruption to the shin portion of the sleeve between the instep portion and the shin portion, an excision to leave the heel of the patient uncovered provided in the transition portion of the sleeve between the foot portion and the shin portion, and one of said chambers situated at a distal extremity of the shin portion of the sleeve extending in one piece into the foot portion and over substantially the whole foot portion.

2. A device as claimed in claim 1, wherein each said valve member comprises a diaphragm clamped within a housing of said valve and separating said supply volume from said control volume.

3. A device as claimed in claim 1 wherein the supply volume of each valve is in communication via a connecting pipe with the corresponding chamber and the valve comprises a central hollow stub in said supply volume forming a valve opening closeable by said pneumatically operated valve member, the stub being connected via a passage extending in the supply volume to the valve outlet for inflating air leading to the next valve.

4. A device as claimed in claim 1 wherein all the said valves are made structurally identical, the supply volume outlet of the last valve in the series being closed off.

5. A device as claimed in claim 1 further comprising a control pipe to supply said control pressure and a feed pipe to supply inflating air to said chambers, said feed and control pipes being externally joined together in the longitudinal direction and produced jointly by co-extrusion.

6. A device as claimed in claim 1 wherein said chambers overlap one another partially as seen in the longitudinal direction of the sleeve.

7. A device as claimed in claim 1 wherein said sleeve, said valves and means connecting said valves to one another and to said chambers are made of materials resistant to disinfectants, acids and alkalis.

8. A device as claimed in claim 7, wherein said sleeve has a covering material made from a fabric which is permeable to air and water vapour and resistant to disinfectants, acids and alkalis.

9. A device as claimed in claim 1 wherein said chambers are produced from precut plastics material sections interwelded thermoplastically in their marginal areas.

10. In combination, a device for treating human extremities as claimed in claim 1, an inflating air feed pipe connecting the inlet to the first valve supply chamber to a compressed air source and a control pipe connecting the first valve control chamber to a source of compressed air.

11. A device for treating human extremities by intermittent compression, comprising:

at least one sleeve adapted to fit around a patient's limb;

a plurality of flexible inflatable chambers attached to said sleeve and arranged in series thereon to be successively inflated;

a plurality of valves each associated with one of said chambers and each comprising a housing enclosing a supply volume, and a control volume separated from one another by a flexible airtight diaphragm arranged to act as a valve member, said supply volume communicating with its associated chamber and having an inlet and an outlet for inflating air, the outlet being closeable by said diaphragm when a predetermined pressure differential prevails between said supply and control chambers, wherein a supply pipe for inflating air is connected to the inlet of a first said valve and all said valves are connected in series, with the inlet of each valve other than the first being connected to the outlet of the preceding valve in the series, and wherein means are provided for supplying a control pressure to the control volumes of said valves to open and close said valve outlets by establishing said pressure differential, whereby when inflating air is supplied to the first chamber of the series through said supply pipe and said first valve with all said valve outlets closed by said control pressure, said first chamber inflates until the pressure therein, and in its associated valve supply volume, rises to overcome said pressure differential and cause said diaphragm to open said outlet to enable the next chamber in the series to be inflated through its respective valve supply volume while keeping said first chamber inflated, and so on until all said chambers are inflated, wherein the sleeve comprises a foot portion including an instep portion and a shin portion, a transition area joining the foot portion without interruption to the shin portion of the sleeve between the instep portion and the shin portion, an excision to leave the heel of the patient uncovered provided in the transition portion of the sleeve between the foot portion and the shin portion, and one of said chambers situated at a distal extremity of the shin portion of the sleeve extending in one piece into the foot portion and over substantially the whole foot portion.

* * * * *